US006592947B1

(12) United States Patent
McCane et al.

(10) Patent No.: US 6,592,947 B1
(45) Date of Patent: Jul. 15, 2003

(54) METHOD FOR SELECTIVE CONTROL OF CORROSION USING KINETIC SPRAYING

(75) Inventors: Robert Corbly McCane, Southfield, MI (US); John Lawrence Bomback, Highland Hts., OH (US); Guilian Gao, San Jose, CA (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/063,335

(22) Filed: Apr. 12, 2002

(51) Int. Cl.[7] ..... B05D 1/02

(52) U.S. Cl. ..... 427/427; 427/191; 427/192; 427/197; 427/201; 427/258; 427/287; 427/299; 427/307; 427/327; 427/328; 427/404; 427/405; 427/422; 427/448; 427/449; 427/451; 427/455; 427/456

(58) Field of Search ..... 427/448, 449, 427/451, 455, 456, 191, 192, 197, 201, 258, 287, 299, 307, 327, 328, 404, 405, 422, 427

(56) References Cited

U.S. PATENT DOCUMENTS 4,840,715 A * 6/1989 Misawa et al. ..... 204/181.1
5,302,414 A 4/1994 Alkhimov et al.
5,691,048 A * 11/1997 Roberto et al. ..... 428/334
5,795,626 A 8/1998 Gabel et al.
6,001,426 A 12/1999 Witherspoon et al.
6,051,274 A * 4/2000 Huber et al. ..... 427/180
6,224,943 B1 5/2001 Knepper et al.
6,372,374 B1 * 4/2002 Li et al. ..... 429/36
6,376,092 B1 * 4/2002 Ishizuka et al. ..... 428/472.3

* cited by examiner

*Primary Examiner*—Bernard Pianalto
(74) *Attorney, Agent, or Firm*—Brooks & Kushman P.C.; Damian Porcari

(57) ABSTRACT

The present invention relates to methods for selectively enhancing corrosion protection of fabricated metal parts. One method of the present invention includes providing a non-galvanized metal sheet to be processed to form the fabricated metal part; selecting a localized region on the non-galvanized metal sheet; roughening the localized region for acceptance of a protective coating; applying a protective coating to localized region; and fabricating the non-galvanized metal sheet into a fabricated metal part. Another method includes providing a galvanized metal sheet; selecting a localized region on the galvanized metal sheet; applying a protective coating to the localized region; and fabricating the galvanized metal sheet into a fabricated metal part. Yet another method includes selecting a localized region on a fabricated metal part; roughening the localized region for acceptance of a protective coating; and applying the protective coating to the localized region.

17 Claims, 2 Drawing Sheets

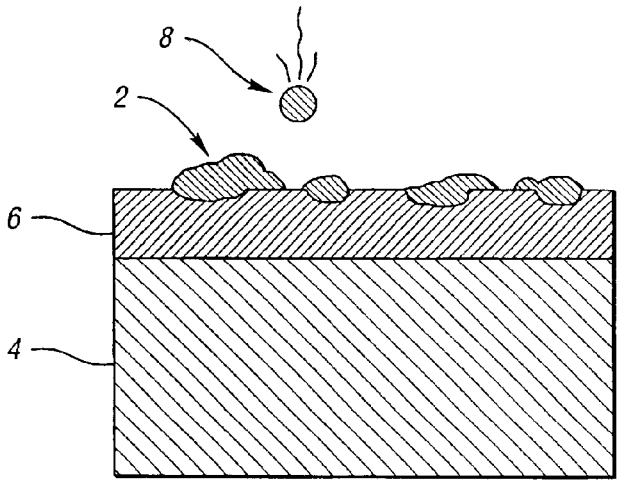
Fig. 1
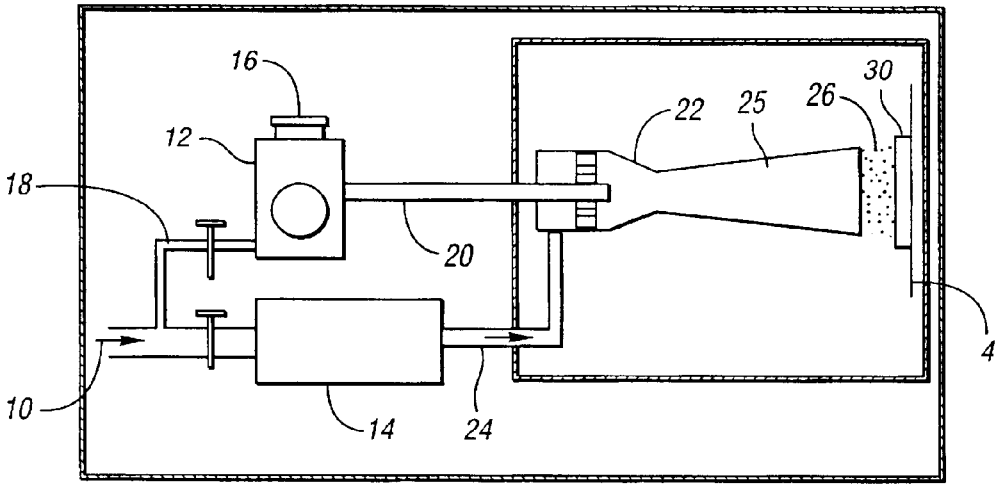
Fig. 2
Fig. 3
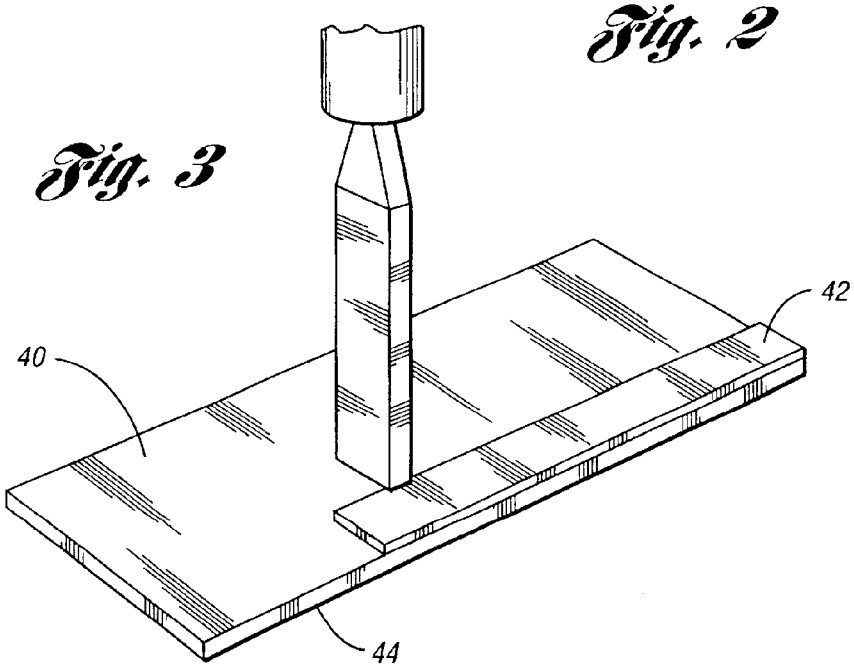

METHOD FOR SELECTIVE CONTROL OF CORROSION USING KINETIC SPRAYING

BACKGROUND OF INVENTION

1. Field of the Invention

The present invention relates to selectively enhancing corrosion protection of fabricated metal structures and, more particularly, to methods of applying a protective coating to metal parts using kinetic spraying.

2. Background Art

"Galvanizing" refers to a broad category of surface coating processes wherein zinc or zinc-rich alloys are deposited on the surfaces of steel sheets or fabricated metal parts. In the automotive industry, as well as other industries, the use of galvanizing for corrosion protection of steel is ubiquitous. The International Zinc Association estimates that worldwide annual usage of zinc for this purpose exceeds 3 million metric tons. Coils of steel, for example, are frequently provided with galvanized coatings through processes such as hot dipping, electro-galvanizing or galvannealing. Such coil-coated steel is subsequently formed into products such as automobile bodies, architectural materials and other products for commercial and household use. The coil-coated steel can be further finished by additional treatments that include phosphating electrophoretic coatings.

Even with the application of galvanic protective coatings to steel, corrosion may still occur, particularly in localized regions where the mechanical integrity of the coatings may be compromised by such processes as joining, cutting, forming or any other manufacturing process which may diminish the capability of protective layers to provide protection to the steel sheet. Hence, to compensate for these potential deficiencies produced during the manufacturing of the galvanized metal parts, post processes, such as painting or phosphating have been utilized.

Fabricated metal parts suffer from corrosion resistance problems as well. For example, metal fuel tanks have extremely high corrosion reliability requirements. Currently, only metal fuel tanks are capable of meeting the most stringent regulatory requirements for low emission vehicles. Corrosion of metal fuel tanks, however, is a critical concern since a single pit can lead to fuel leakage and attendant system failure. Current practice for corrosion prevention of steel fuel tanks involves use of electro-galvanized (e.g., Zn—Ni alloy) sheet steel as the base metal, combined with an aluminum-rich, epoxy paint. At the tank seam element as well as attachment points for inlets and fuel pump, the corrosion performance can be diminished due to possible inherent defects associated with the manufacture of the tank.

There exists a need in the automotive industry, as well as other industries, for a simple, low-cost method for selectively applying a protective coating to metal parts for corrosion resistance of localized regions that may or may not have an existing protective coating. This type of method would be especially advantageous where an original coating protection has been compromised by various manufacturing processes such as cutting or welding. Furthermore, there is a need to provide for enhanced corrosion protection at localized regions of fabricated metal structures that may or may not have an existing protective coating.

SUMMARY OF INVENTION

The present invention is related to methods for selectively enhancing corrosion protection of fabricated metal parts.

One preferred method of the present invention involves selectively enhancing corrosion protection of a fabricated metal part. The preferred method includes providing a non-galvanized metal sheet to be processed to form a fabricated metal part; selecting a localized region on the non-galvanized metal sheet; roughening the localized region for acceptance of a protective coating; applying a protective coating to the localized region; and fabricating the non-galvanized metal sheet into a fabricated metal part.

If not treated with the protective coating, the localized region becomes a post-fabricated area particularly susceptible to corrosion. Upon applying the protective coating to the localized region, the post-fabricated area is particularly resistant to corrosion. The protective coating is applied by a device capable of impact fusion of solid metal particles. The corrosion protection of the post-fabricated area is enhanced by the selectively deposited protective coating. The protective coating may be a galvanized coating. However, non-galvanized coatings can be utilized as long as corrosion resistance is enhanced (viz. oxidative or high temperature corrosion protection).

In another preferred embodiment, a method includes providing a galvanized metal sheet to be processed to form a fabricated metal part; selecting a localized region on the galvanized metal sheet; applying a supplemental galvanized coating to the localized region; and fabricating the galvanized metal sheet into the fabricated metal part. The application of the galvanizing coating forms a galvanic layer on the surface of the prefabricated metal sheet. If not treated with the supplemental galvanized coating, the localized region becomes a post-fabricated area particularly susceptible to corrosion. Upon applying the supplemental galvanic coating to the localized region, the post-fabricated area is particularly resistant to corrosion. The corrosion protection of the post-fabricated area is enhanced due to the selective application of the galvanic coating. The galvanized coating is applied by a device capable of impact fusion of solid metal particles.

One preferred method includes selecting a localized region on a fabricated metal part; roughening the localized region for acceptance of a protective coating; and applying a protective coating to the localized region. The protective coating is applied by a device capable of impact fusion. According to this method, the fabricated metal part is treated. For example, an element on a fuel tank seam may lack corrosion protection. The method contemplated enhances or restores corrosion protection to the localized region defined by the weldment.

These and other advantages, features, and objects of the present invention will become more apparent to those of ordinary skill in the art upon reference to the following description.

BRIEF DESCRIPTION OF DRAWINGS

FIG. 1 depicts an application of a protective coating on a metal sheet using impact fusion;

FIG. 2 is a schematic representative of a cold gas dynamic spray system;

FIG. 3 depicts an application of a protective coating on a metal sheet using a high-velocity, gas-dynamic nozzle;

DETAILED DESCRIPTION

Figure 4:
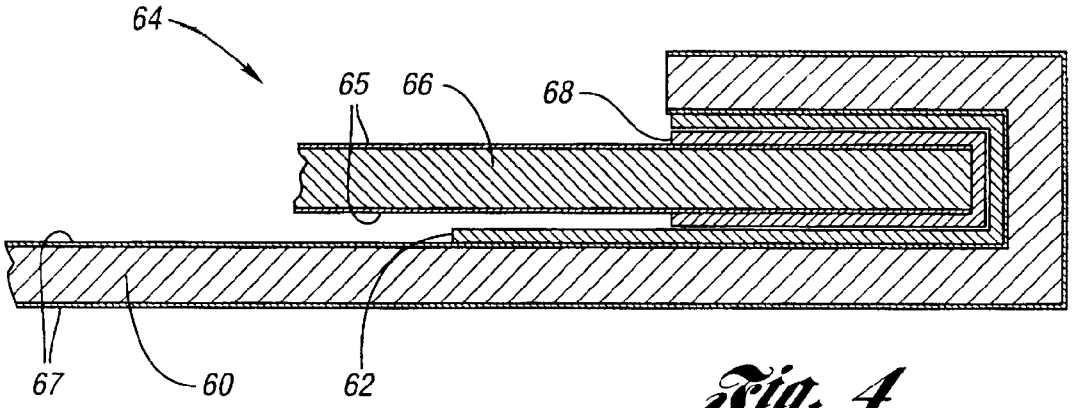
FIG. 4 depicts in cross-section a hem joint formed between two panels with a protective coating applied to each panel before forming the joint.

In accordance with the present invention, protective coatings are applied to localized regions of metal sheets or fabricated metal parts. The application device is capable of impact fusion.

FIG. 1 illustrates a process of applying a protective coating 2 with a device capable of impact fusion onto a metal surface. Zinc-rich galvanized layer 6 is formed on a surface of steel substrate 4 by any conventional means such as hot dipping or electro-galvanizing. Kinetically accelerated zinc (or zinc alloy) particles 8 impact on the galvanized layer 6, and form the protective coating 2 through a repetitive process of ballistic impaction and self-adherence or "impact fusion". Zinc particles 8 readily adhere to the zinc already present in the galvanized pre-coating, as well as to zinc particles which have already impacted and adhered to this surface.

For any given powder metal, there exists a critical particle velocity at which particles accumulate on substrate 4 at a rate greater than which they are removed by ablation due to the incoming stream. Principal parameters contributing to the critical particle velocity for a given powder metal are: (1) powder metal type, (2) powder metal crystal and microstructure, (3) substrate type, (4) substrate surface finish, (5) powder size distribution, (6) propellant gas type, (7) propellant gas velocity determined by the pressure and temperature of the propellant gas entering the kinetic spray system, (8) converging/diverging nozzle internal shape, and (9) nozzle standoff distance from the substrate surface.

In the case of spraying of zinc-based powders on galvanized or welded steel, the condition of substrate 4 may reflect either the pre-existing zinc alloy layer from the galvanizing process, or a metallic surface as would exist following weldment by resistance, laser fusion, or other process.

In the case of either bare steel or pre-welded zones to be coated by selective galvanizing, the surface is preferably prepared to remove poorly adherent oxide films or debris from the welding process, thereby permitting accumulation of the zinc or zinc-alloy spray by direct attachment to the base metal. A variety of surface preparation techniques for this purpose are well known in the thermal-spray art, including grit blasting with abrasive particles, water-jet blasting either with pure water or suspended abrasives, blasting with solid $CO_2$ particles, electro-discharge machining, plasma discharge roughening, machining and coining. The preferred method of the present invention for surface roughening of pre-welded or bare steel surfaces for protection with zinc, is roughening with focused jets of abrasive particles or water jets.

In the case of the preexisting zinc alloy layer, the remnant galvanizing zinc alloy layer is sufficiently compliant to permit a ready development of the impact-fusion protective layer without additional surface modification.

In the case of selectively supplanting preexisting galvanized layers with zinc or zinc alloy powders, or for addition of zinc to pre-roughened surfaces, the conditions which promote formation of zinc-rich surfaces are: (1) zinc or zinc-alloy powder of at least 70% by weight zinc, with typical alloying additions of aluminum, copper, magnesium, iron, lead, cadmium, tin or nickel, (2) particle powder size in the range of 5–50 microns; (3) for helium as a propellant, gas pressure in the range 100–300 psi, gas preheat temperature in the range of 150–400° C., particle velocities in the range of from 350–650 m/sec., (4) for air or nitrogen propellant, gas pressure in the range 100–450 psi, gas temperatures in the range of 170–500° C., particle velocities in the range of 350–650 m/sec.

According to one embodiment of the present invention, a high-velocity, gas-dynamic spray system is utilized to apply the protective coating to the localized region. FIG. 2 schematically illustrates a typical high-velocity, gas-dynamic system, where propellant gas 10, typically helium, nitrogen, air or a mixture of these gasses, is introduced at an elevated pressure into powder feeder 12, capable of withstanding high pressure, and gas pre-heater 14. Powdered metal is introduced into the feeder 12 via a sealing closure 16. Typical powder metals of interest include, but are not limited to, zinc, aluminum, copper, iron, tin, nickel, titanium, molybdenum, silver, gold, and alloys thereof.

Desirable characteristics of pure metal powders for high-velocity, gas-dynamic spraying are generally: (1) a degree of plasticity of the powder, allowing it to generate dense deposits through impact fusion, (2) size range of the powder in the vicinity of 5–50 microns, and (3) sufficiently high purity as to permit an active metal to render galvanic protection by sacrificial anodization to the metal sheet or fabricated metal part upon which it is deposited.

The choice of a metal powder for a given application will generally depend upon its galvanic potential relative to the base metal where protection is desired. For example, the most common galvanic protection of ferrous materials will be by zinc. Ferrous materials can be galvanically protected by aluminum, magnesium and alloys thereof. It should be understood that the selection of a galvanical metal powder is dependent upon the metal used for the metal sheet or fabricated metal part and the economics and practicality of spraying the metal powder. It should also be understood that metals which form stable and protective passivations, even while not sacrificially anodic to the base metal, are likely to be used to form protective coatings as well. An example is the application of high-purity aluminum to an aluminum alloy for purposes of developing a surface which is more readily passivated or less corrosion prone than the base material.

Powder metal introduced into the powder feeder 12 is entrained in a high-pressure gas flow 18 entering powder feeder 12. Entrained powder 20 exits powder feeder 12, and is introduced into the converging/diverging nozzle 22. High pressure, high-temperature gas stream 24 is introduced into converging/diverging nozzle 22. The introduction of entrained powder 20 and gas stream 24 into converging/diverging nozzle 22 causes a simultaneous temperature reduction and gas volume expansion, with an attendant velocity increase, often approaching or exceeding the sound velocity for the particular propellant gas 10 for the conditions in nozzle cone 25.

Upon exiting converging/diverging nozzle 22, metal particles 26 are collected upon substrate 4 to form protective coating 30. The kinetic energy of the impacting metal particles 26 is partially converted into a work of deformation, such that particles plastically flow and can thus adhere to one or more of the following substrate features: (1) surface irregularities, either naturally present or introduced by processing on the surface of the parent metal being protected, (2) an accepting prior metal coating (e.g., pre-galvanized steel), which deforms under impact of the spray particles, or (3) previously adhering particles of the spray metal itself.

Selective deposits are produced using the high-velocity, gas-dynamic applicator of FIG. 2. The converging/diverging nozzle may be placed on a programmable robot arm to produce selective regions of increased zinc alloy or other metallic protection.

Alternatively, the work piece can be manipulated under a stationary nozzle for the case of simple geometries such as strips or coils as illustrated in FIG. 3. FIG. 3 shows a piece of sheet material 40, receiving a protective layer of zinc 42 near edge 44. Edge 44 may become a fabricated metal part, such as a hem flange.

Selective corrosion protection affords the opportunity to place additional amounts of galvanic protection where needed on either a pre-galvanized or an untreated structure. The thickness of the selectively galvanized layer can be determined by adjusting one or more of the following parameters: (1) powder feed rate into the gun, (2) work piece or gun traverse speed, (3) number of passes of gun over region.

The thickness will typically be in the range of 10–100 microns of zinc or zinc alloy added to either a preexisting uniform layer or the bare substrate which has been prepared to accept the coating layer by appropriate surface roughening. For the case of pre-galvanized sheet, additional pretreatment of the sheet is not required.

For component pieces which are assembled into structures such as automobile bodies and closures (e.g., doors, hoods, deck lids, lift gates), selective application of a protective coating can be used to augment corrosion protection. FIG. 4 illustrates a hem region 64. Outer body panel 60 receives a galvanizing coating 67 and a selective protective coating 62. Inner body panel 66 receives a galvanizing coating 65 and a selective protective coating 68. Outer body panel 60 is bent to form hem 64 with inner panel 66.

The selective galvanizing process as depicted in FIG. 4 is preferred when it is possible for each individual panel of the assembly to receive selective galvanizing in advance of assembly, thereby imparting additional galvanic and barrier properties to each constituent part of an assembly. Such a structure is expected to significantly delay the onset of perforation corrosion in the hem area by providing a more extensive reservoir of sacrificial anode than is available from the pre-galvanized sheet steel typically used without the necessity of increasing the galvanic protection in areas of the sheet removed from the hem. This provides a level of increased corrosion resistance only at areas where corrosion resistance is particularly sought, while keeping any increase in cost at a minimum.

According to another embodiment of the present invention, the selective coating is placed on either outer body panel 60 or inner body panel 66, thereby providing a single reservoir of additional sacrificial anode, but without the benefit of providing the additional barrier protection on each component piece.

Figure 5:
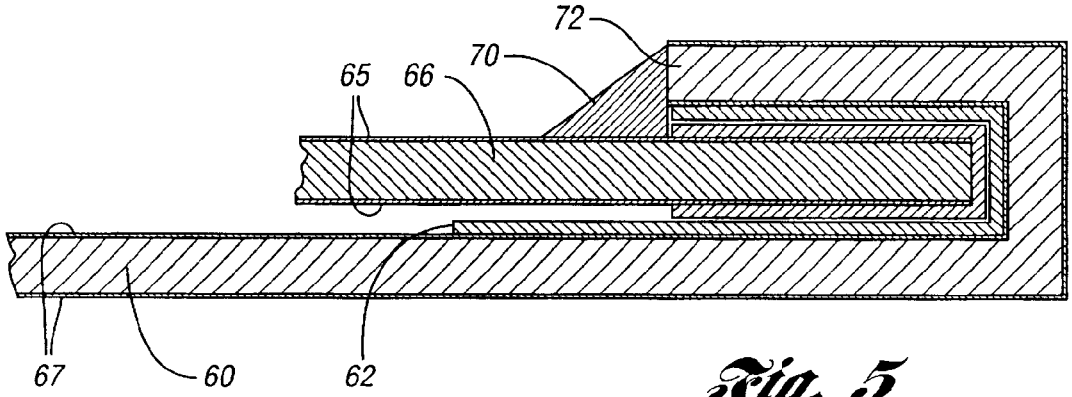
FIG. 5 depicts in cross-section a hem joint formed between two panels with a protective coating applied to each panel with an additional fillet before forming the joint.

FIG. 5 depicts an alternative embodiment using the selective galvanizing process of the present invention. According to FIG. 5, a final sealing layer 70 of zinc alloy is placed as a filler to augment corrosion resistance of the cut edge 72. Since cut edge 72 does not have any zinc coating on the surface, it is more vulnerable to corrosion than regions where a more uniform layer of galvanizing has been developed on the parent metal.

Experimentally, two hem flanges were produced with galvanized metal sheets. One of the flanges received an additional 50 microns of kinetically sprayed zinc, depicted as protective coatings 62 and 68 in FIGS. 4 and 5. Corrosion tests were conducted on the two flanges by controlling the level of humidity, temperature and salt-water exposure. This corrosion test was run for 100 cycles, where a cycle is a period of 24 hours. Results of the corrosion test showed that the selectively galvanized hem flange showed minimal blistering adjacent to cut edge 72, whereas the conventional processing resulted in substantial red rust corrosion and blistering.

The methods of the current invention are particularly applicable to localized enhancement of corrosion performance of components that have extremely high corrosion reliability requirements. Fabricated metal parts suffer from diminished corrosion resistance as well. For example, metal fuel tanks have extremely high corrosion reliability requirements. Selective kinetic spraying can be applied augmenting the corrosion resistance of localized areas such as the seam weldment (found in fuel tanks, for example), filler-tube weldments, and attachment flanges for fuel pump or sender units.

Figure 6:
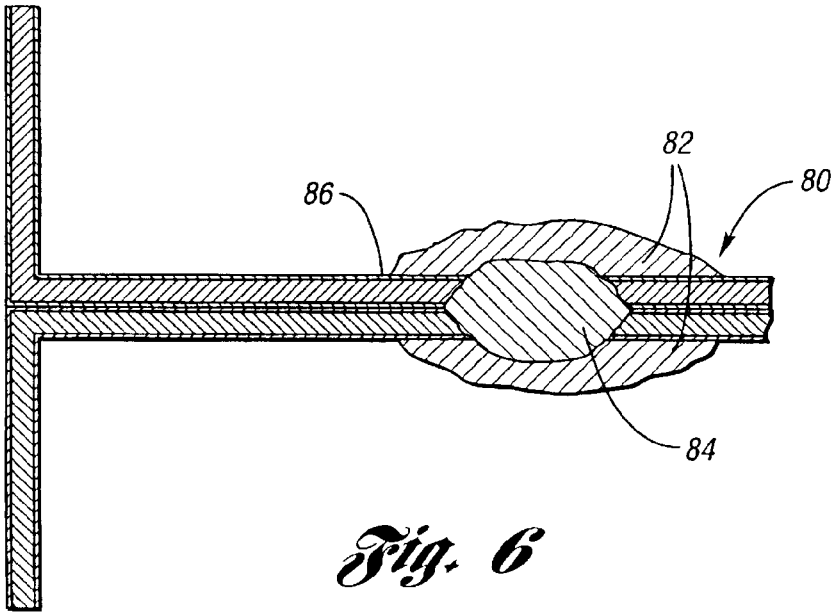
FIG. 6 depicts an application of a protective coating to a weldment on a fuel tank seam.

According to FIG. 6, the cross section of a steel fuel tank weld seam 80, has been impact fusion sprayed with high-purity zinc to form the protective beads 82, following a surface preparation step by grit-blasting the seam area with aluminum oxide prior to cold spray application. Weld bead 84 has caused disruption of the original protective coatings 86, comprised of electro-galvanized Zn—Ni with aluminum-filled epoxy over-layer. Protective coating 82 of thickness approximately 25 microns of pure zinc is deposited on the seam 80 according to the parameters set forth earlier, using helium gas as the propellant. By selectively galvanizing the seam 80, it is potentially possible to eliminate the post-weld painting step on some fuel tanks, and thereby the environmental burdens associated with the paint process including VOCs, water treatment and solid waste sludge.

While cold-gas dynamic spraying is a preferred method for achieving selective galvanizing, it will be apparent that other "kinetic" processes based either on gas dynamics or other means of particle acceleration would also be applicable. The gas-dynamic approach employing a converging/diverging nozzle develops a highly collimated "beam" of metal particles that form the galvanizing layer. Other "high-velocity, oxy-fuel" or HVOF thermal spray processes can equally develop such collimated particle streams. For zinc or zinc-alloy powder as would be used in selective galvanizing, thermal excursions can lead to undesirable zinc fuming. Emerging "kinetic" processes based on tribo-accleration as disclosed in U.S. Pat. No. 5,795,626, or pulsed plasma processes as disclosed in U.S. Pat. No. 6,001,426, the disclosures of which are hereby incorporated by reference, might equally be envisioned in lieu of the gas-dynamic approach for producing highly collimated material beams.

While the present invention has been described in detail in connection with preferred embodiments, it is understood that these embodiments are merely exemplary and the invention is not restricted thereto. It will be recognize by those skilled in the art that other variations and modifications can be easily made within the scope of this invention that is defined by the appended claims.

What is claimed is:

1. A method for enhancing the corrosion protection of a galvanized metal part having a first surface portion and a second surface portion, less susceptible to corrosion than the first surface portion, the method comprising:

identifying the first surface portion on the metal part, wherein the first surface portion having degraded galvanic protection relative to the second surface portion due to a manufacturing process;

roughening the first surface portion for acceptance of a galvanic protective coating; and applying the galvanic protective coating to essentially only the first surface portion by a device capable of impact fusion of solid metal particles onto the galvanized metal part, wherein the corrosion protection of the first surface portion is enhanced.

2. The method of claim 1 wherein the galvanic metal part comprises a steel fuel tank, the first surface portion comprises a weldment on the steel fuel tank, and the manufacturing process is comprised of welding.

3. A method for enhancing corrosion protection of a fabricated metal part, the method comprising:

providing a metal sheet to be processed to form the fabricated metal part and having a first surface portion adjacent to a second surface portion;

selecting the first surface portion on the metal sheet, wherein the first surface portion is more susceptible to corrosion than the second surface portion after fabrication of the metal sheet into the fabricated metal part; and applying a protective coating to essentially only the first surface portion by a device capable of impact fusion of solid metal particles onto the metal sheet, without application of the protective coating, the first portion becomes a post-fabricated area particularly susceptible to corrosion after the metal sheet is processed to form the fabricated metal part.

4. The method of claim 3 wherein the device capable of impact fusion of solid metal particles onto the metal sheet is a high-velocity, cold gas-dynamic nozzle.

5. The method of claim 4 wherein the applying step is accomplished without masking the metal sheet.

6. The method of claim 4 wherein the protective coating is comprised of a galvanic coating.

7. The method of claim 6 wherein the metal sheet is comprised of iron or iron alloy.

8. The method of claim 7 wherein the galvanic protective coating is comprised of zinc or zinc alloy.

9. The method of claim 3 further comprising manipulating the partially coated metal sheet to form the fabricated metal part.

10. The method of claim 9 wherein the manipulating step is comprised of bending the metal sheet over a second metal sheet to form a hem flange structure.

11. The method of claim 10 wherein the post-fabricated area particularly susceptible to corrosion without application of the protective coating is comprised of the hem flange structure.

12. The method of claim 3 wherein the metal sheet is comprised of a galvanized metal sheet.

13. The method of claim 3 wherein the metal sheet is a nongalvanized metal sheet.

14. The method of claim 3 further comprising roughening the first surface portion for acceptance of the protective coating prior to the application step.

15. A method for enhancing the corrosion protection of a metal part having a first surface portion and a second surface portion, less susceptible to corrosion than the first surface portion, the method comprising:

identifying the first surface portion on the metal part, wherein the first surface portion having degraded corrosion protection relative to the second surface portion due to a manufacturing process;

roughening the first surface portion for acceptance of a passivating protective coating; and applying the passivating protective coating to essentially only the first surface portion by a device capable of impact fusion of solid metal particles onto the metal part, wherein the corrosion protection of the first surface portion is enhanced.

16. The method of claim 15 wherein the metal part is comprised of magnesium or magnesium alloy.

17. The method of claim 16 wherein the passivating protective coating is comprised of aluminum or aluminum alloy.

* * * * *

UNITED STATES PATENT AND TRADEMARK OFFICE

CERTIFICATE OF CORRECTION

PATENT NO. : 6,592,947 B1
DATED : July 15, 2003
INVENTOR(S) : McCune et al.

It is certified that error appears in the above-identified patent and that said Letters Patent is hereby corrected as shown below:

Title page,
Item [75], Inventors, please replace "McCane; Robert Corbly (Southfield, MI)" with -- McCune; Robert Corbly (Southfield, MI) --.

Signed and Sealed this

Third Day of August, 2004

JON W. DUDAS
*Acting Director of the United States Patent and Trademark Office*